US005655953A

United States Patent [19]

Murakami et al.

[11] Patent Number: 5,655,953

[45] Date of Patent: Aug. 12, 1997

[54] MANUFACTURING METHOD OF WAVE CAM FOR A COMPRESSOR

[75] Inventors: Kazuo Murakami; Kazuo Awamura; Shinya Saito; Toshiro Fujii, all of Kariya, Japan

[73] Assignee: Kabushiki Kaisha Toyoda Jidoshokki Seisakusho, Kariya, Japan

[21] Appl. No.: 538,238

[22] Filed: Oct. 3, 1995

Related U.S. Application Data

[63] Continuation-in-part of Ser. No. 475,043, Jun. 7, 1995, abandoned, which is a continuation-in-part of Ser. No. 363,609, Dec. 23, 1994, which is a continuation-in-part of Ser. No. 254,970, Jun. 7, 1994, abandoned.

[30] Foreign Application Priority Data

Oct. 4, 1994 [JP] Japan ..... 6-240156

[51] Int. Cl.[6] ..... B24B 1/00

[52] U.S. Cl. ..... 451/62; 451/10; 451/251; 451/246

[58] Field of Search ..... 451/62, 9–11, 451/242, 246, 251, 228, 277

[56] References Cited

U.S. PATENT DOCUMENTS

| | | | |
|---|---|---|---|
| 2,176,300 | 10/1939 | Fette | 417/254 |
| 4,621,463 | 11/1986 | Komatsu et al. | 451/62 |
| 4,624,610 | 11/1986 | Phillips et al. | 451/62 |
| 4,756,239 | 7/1988 | Hattori et al. | 92/71 |
| 5,125,775 | 6/1992 | Breuer et al. | 451/62 |
| 5,392,566 | 2/1995 | Wedeniwski | 451/62 |
| 5,472,368 | 12/1995 | Zollig | 451/62 |

FOREIGN PATENT DOCUMENTS 3309424 3/1983 Germany .

*Primary Examiner*—Eileen P. Morgan

*Attorney, Agent, or Firm*—Brooks Haidt Haffner & Delahunty

[57] ABSTRACT

A wave cam is rotatably and integrally mounted on a drive shaft of a compressor. Pistons are connected to cam surfaces of the wave cam via shoes. The shoes move relatively to the cam surface along a predetermined orbital path. The predetermined orbital path defined on the cam surfaces is ground by bringing a grinding surface of a grinding stone, attached to a rotary shaft, into contact with the cam surfaces. During grinding, the grinding surface is perpendicular in respect with the cam surface. The axis of the grinding stone coincides with the axis of the rotary shaft.

33 Claims, 12 Drawing Sheets

SENSOR 56
TO 52
MOTOR 55
MOTOR 53
SENSOR 54
TO 52
R
42
40
41
TO 52
SENSOR 60
D'
30d
K'
Y
30c
26
30
44
L5
30a
-A'
43
30b
30d
MOTOR 59
MOTOR 57
SENSOR 58
TO 52

MANUFACTURING METHOD OF WAVE CAM FOR A COMPRESSOR

This application is a continuation-in-part application of U.S. patent application Ser. No. 08/475,043, filed on Jun. 7, 1995, now abandoned which is a continuation-in-part application of U.S. patent application Ser. No. 08/363,609, filed on Dec. 23, 1994, (pending) which is a continuation-in-part application of U.S. patent application Ser. No. 08/254,970, filed on Jun. 7, 1994 now abandoned.

BACKGROUND OF THE INVENTION

1. Field of the Invention

The present invention relates generally to a compressor which compresses fluid, introduced into cylinder bores, by reciprocating pistons. More particularly, it pertains to a wave cam plate type compressor which reciprocates pistons by rotating a wave cam integrally attached to a drive shaft.

2. Description of the Related Art

In the prior art, swash plate type compressors are provided with a drive shaft, a swash plate, and pistons accommodated in associated cylinder bores. The swash plate is integrally fixed to the drive shaft and connected to each piston. In this type of compressor, fluid introduced into the cylinder bores is compressed by reciprocating movement of the pistons Within the bores. The reciprocation is caused by integral rotation of the drive shaft and swash plate. In this compressor, a movement diagram indicating axial displacement of a point following the swash plate surface during one rotation of the swash plate shows a single cycle sine wave curve. Hence, one compression stroke is performed per rotation of the drive shaft in the swash plate type compressor. However, compressors, normally used for vehicles, are required to rapidly cool the interior of the vehicle when the temperature therein is high. Accordingly, there was a demand for a compressor capable of discharging a larger volume without enlarging its size.

Wave cam type compressors have been developed to provide a compressor with a smaller size and an increased discharge volume as compared to swash plate type compressors. The wave cam type compressors are provided with a drive shaft, a wave cam, and pistons accommodated in associated cylinder bores. The wave cam is integrally fixed to the drive shaft and connected to each piston; In this type of compressor, fluid introduced into the cylinder bores is compressed by reciprocating movement of the pistons within the bores. The reciprocation is caused by integral rotation of the drive shaft and the wave cam. In the wave cam type compressor, a movement diagram indicating axial displacement of a point following the wave cam surface during one rotation of the wave cam has the shape of a double cycle sine wave curve. Hence, two compression strokes are performed per rotation of the drive shaft in the wave cam type compressor. Thus, a wave type cam type compressor has a larger discharge volume and a smaller size than a swash plate type An example of such a wave cam type compressor is disclosed in Japanese Unexamined Patent Publication No. 57-110783. This compressor employs a wave cam having a front and a rear surface, and double-headed pistons having heads on its two ends. A roller, interposed between each cam surface and each piston, is rotatably and permanently fitted within the piston. Rotation of the wave cam moves the rollers relatively with respect to the wave cam surfaces, axially displacing the contact point between the roller and the piston to reciprocate the pistons. The reciprocation of the pistons is based on the curve of the cam surface.

As shown in FIG. 10, a prior art wave cam 80 has a cam surface 81 including concave surfaces 81*a* and convex surfaces 81*b*. The surfaces 81*a*, 81*b* are formed continuously. When the center points of the concave surfaces 81*a* are aligned with a piston (not shown), the piston is located at a bottom dead center position. When the center points of the convex surfaces 81 *b* are aligned with the piston, the piston is located at a top dead center position.

The cam surface 81 of the wave cam 80 shown in FIG. 10 reciprocates pistons via rollers (not shown). Therefore, the cam surface 81 of the wave cam 80 requires high precision grinding. To grind the cam surface 81, the wave cam 80 is rotated in one direction while a grinding stone 84, disposed parallel to the cam surface 81, is rotated by a shaft 83.

However, the shape of the cam surface 81 having continuous concave and convex surfaces 81*a*, 81*b* causes problems described below during its grinding.

FIGS. 11 and 12 show the cam surface 81 which is to be ground by a grinding stone 84. FIG. 11 shows the contact area $\alpha$ between the cam surface 81 and the grinding stone 84 during grinding of the convex surface 81*b*. FIG. 12 shows a contact area $\beta$ between the cam surface 81 and the grinding stone 84 during grinding of the concave surface 81*a*. As apparent from these drawings the contact area $\alpha$ is different from the contact area $\beta$. Therefore, grinding conditions differ between the concave and convex surfaces 81*a*, 81*b*. This lowers grinding accuracy, especially at the boundary portions between the concave and convex surfaces 81*a*, 81*b*, end may result in the cam surface 81 having inconsistent surface roughness and dimensions. As a result, rolling of the rollers between the wave cam 80 and the pistons may be rough and may cause a decrease in compressing efficiency of the compressor.

To cope with these problems, a wave cam 91 having a cam surface 92 that is entirely a convex surface 92*a*, as shown in FIG. 13, may be used. The contact area with a grinding stone is substantially equal at ell points along the entire circumference of the cam surface 92.

However, the wave cam 91 may decrease grinding ability of the grinding stone due to ground dust clogging the grinding surface of the grinding stone. When the grinding surface becomes clogged, it is necessary to increase the pressing force of the grinding stone on the cam surface 92 to ensure the same predetermined grinding ability while continuously using the same grinding stone. The reaction force acting on the grinding stone becomes large when the pressing force is increased. Accordingly, when the grinding stone 84 shown in FIG. 10 is used to grind the cam surface 92, the pressing force deflects its rotary shaft 83. This leads to unsatisfactory contact between the grinding stone 84 and the cam surface 92 thus decreasing the grinding accuracy of the grinding stone 84 on the cam surface 92.

Furthermore, a plurality of wave cams 91 are successively ground by a single grinding stone in the manufacturing process. Hence, a grinding stone which may be used for a long period of time is desirable in the view point of manufacturing efficiency of the wave cam 91. Accordingly, a wave cam 91 having a cam surface 92 capable of prolonging the tool life of the grinding stone is desired.

SUMMARY OF THE INVENTION

Accordingly, it is a primary objective of the present invention to provide a method for efficiently grinding cam surfaces of a wave cam.

Another objective of the present invention is to provide a method for grinding the cam surfaces of the wave cam which is capable of suppressing grinding resistance changes of grinding tools during grinding of the cam surfaces to attain high grinding accuracy.

To achieve the foregoing objectives, a wave cam used in a compressor includes a cam surface which has a predetermined orbital path for a cam follower relatively movable with respect to the cam surface. The orbital path of the cam surface is ground by a grinding stone mounted to a rotary shaft. The grinding method comprising steps of arranging the rotary shaft perpendicular to the cam surface and moving an end surface of the grinding stone relatively to the cam surface on the orbital path.

BRIEF DESCRIPTION OF THE DRAWINGS

The features of the present invention that are believed to the novel are set forth with particularity in the appended claims. The invention, together with objects and advantages thereof, may best be understood by reference to the following description of the presently preferred embodiments together with the accompanying drawings in which:

FIG. 9(*b*) is a schematic view of a wave cam having a concave surface on one side and a convex surface on the other side according to another embodiment;

DETAILED DESCRIPTION OF THE PREFERRED EMBODIMENT

An embodiment of a method for manufacturing a wave cam according to the present invention will now be described with reference to the drawings.

Figure 1:
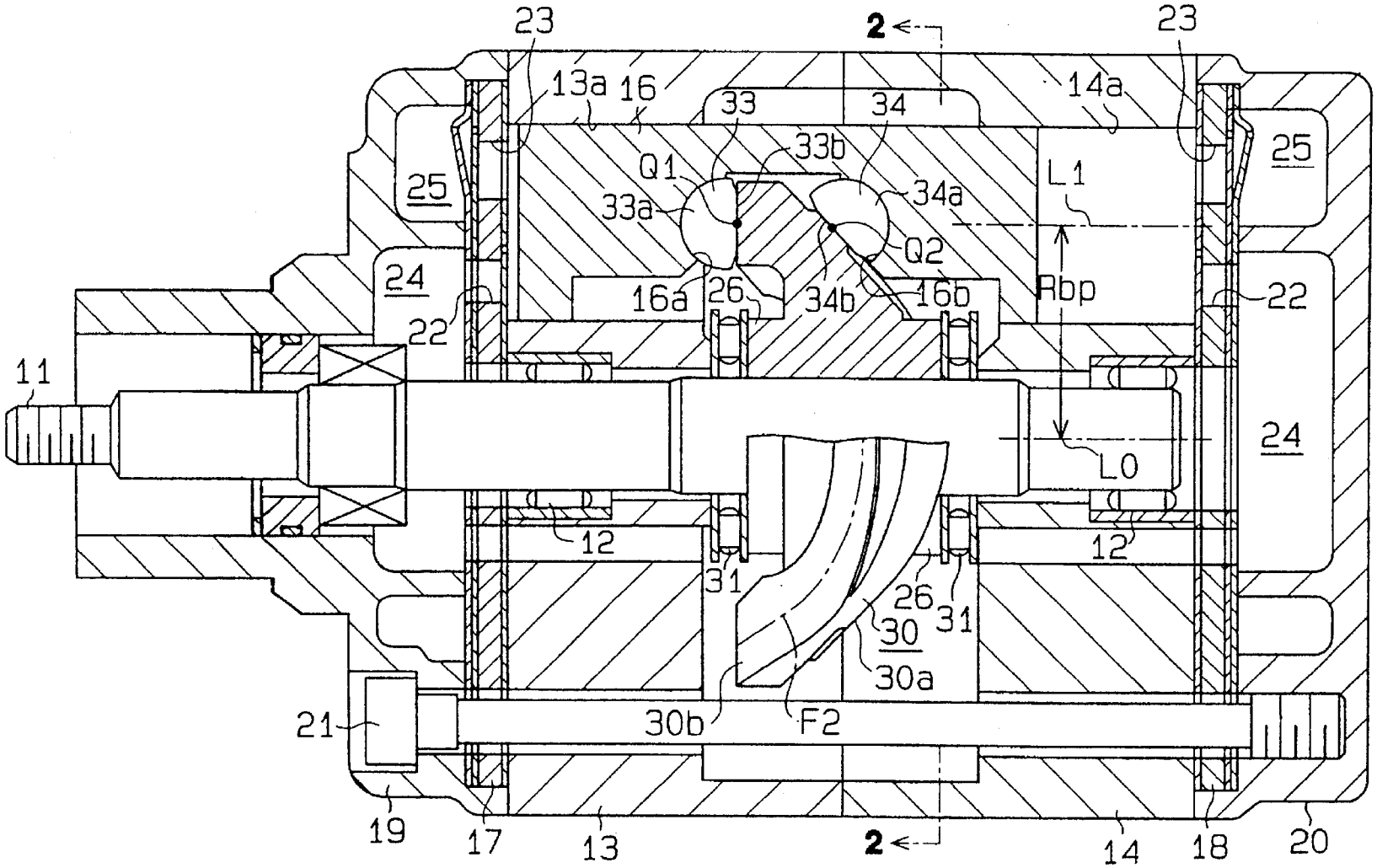
FIG. 1 is a longitudinal-sectional view showing a wave cam type compressor according to an embodiment of the present invention.

As shown in FIG. 1, a drive shaft 11 is rotatably supported in a pair of cylinder blocks 13, 14 by bearings 12. Pairs of longitudinally aligned cylinder bores 13*a*, 14*a* are formed in the two cylinder blocks 13, 14 about the shaft 11 at equal angular intervals. A reciprocal double-headed piston 16 accommodated in each pair of cylinder bores 13*a*, 14*a*. The piston 16 is provided with a piston head on each end. A front housing 19 and a rear housing 20 are securely fastened by bolts 21 to a front end of the cylinder block 13 and a rear end of the cylinder block 14 with valve plates 17, 18 provided between the blocks 13, la and the housings 19, 20, respectively. Suction chamber 24 and discharge chambers 25 are defined between the valve plates 17, 18 and the associated housings 19, 20. The chambers 24, 25 are respectively communicated with each cylinder bore 13*a*, 14*a* via suction ports 22 and discharge ports 23, which are formed in the valve plates 17, 18.

A wave cam 30 fixed to the drive shaft 11 rotates integrally with the shaft 11. The wave cam 30 has a front cam surface 30*b* and a rear cam surface 30*a*. Thrust bearings 31 are provided between the wave cam 30 and the cylinder blocks 13, 14 to absorb thrust acting on the drive shaft 11. Semispherical shoes 33, 34 are interposed between each cam surface 30*b*, 30*a* and each piston 16. Each shoe 33, 34 has a spherical surface 33*a*, 34*a* and a flat surface 33*b*, 34*b*. The spherical surfaces 33*a*, 34*a* are received in associated recess portions 16*a*, 16*b* which are formed in the piston 16. The flat surfaces 33*b*, 34*b* slide on the associated cam surfaces 30*b*, 30*a*.

Figure 2:
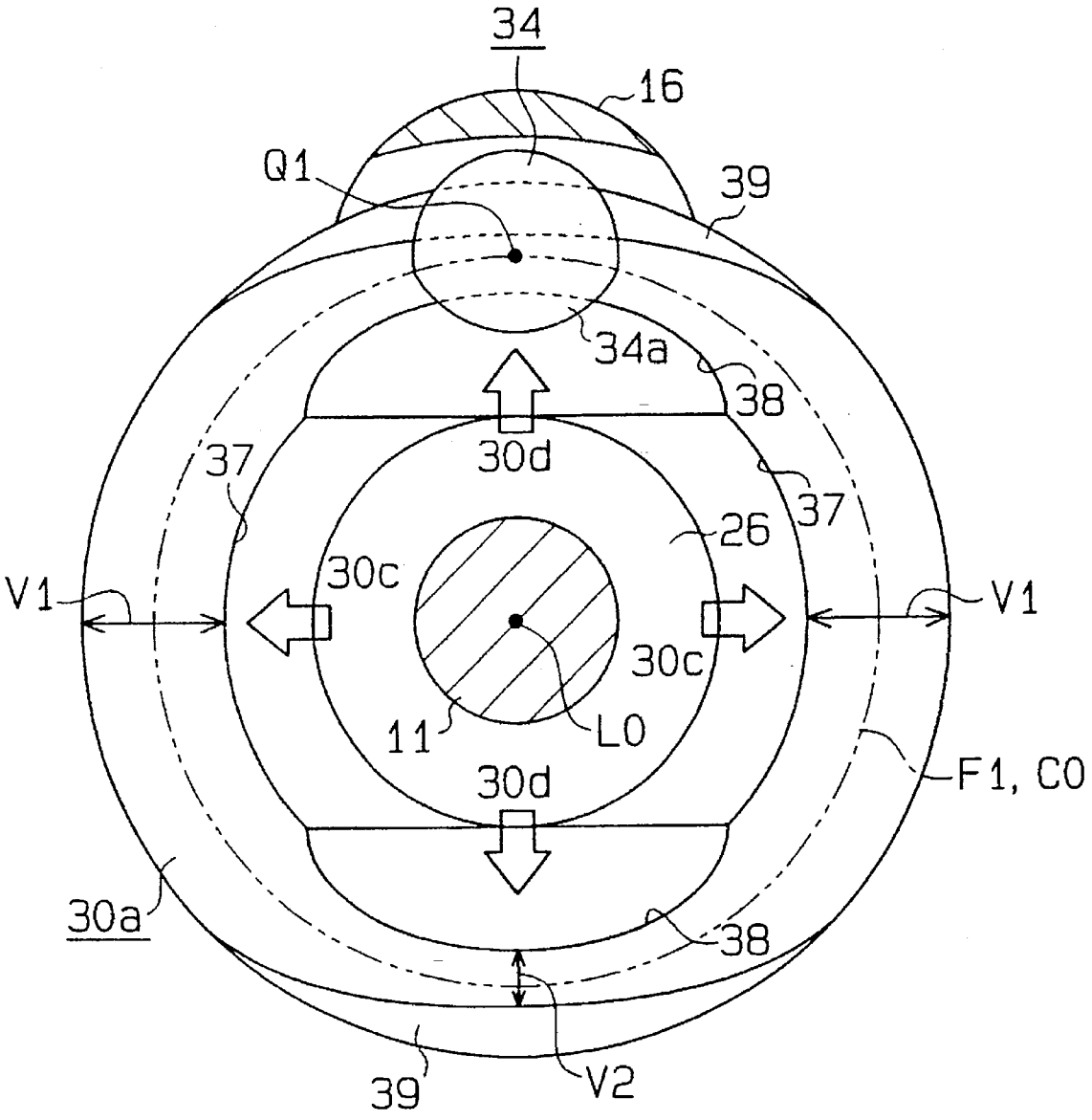
FIG. 2 is a cross-sectional view of FIG. 1 taken on line 2—2.
Figure 3:
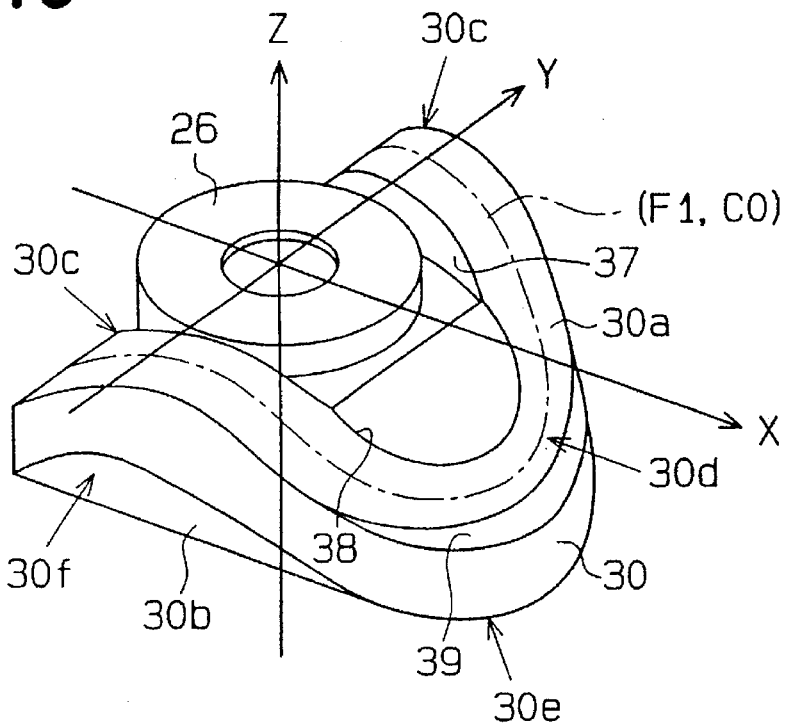
FIG. 3 is a perspective view showing a wave cam with a cylindroid surface.

As shown in FIGS. 2 and 3, an imaginary circumference C0 corresponds to the arrangement of axes L1 of the cylinder bores 13*a*, 14*a*. As shown in FIGS. 1 through 3, a set of movement curves F1, F2 on the cam surfaces 30*a*, 30*b*, respectively, are defined by the intersection of an imaginary cylinder having an axis coinciding with L0 and a circumference equal to C0. The center of the circumference C0 and the center axis of the wave cam 30 both coincide with the axis L0 of the drive shaft 11. The radius of the circumference C0 is Rbp as shown in FIG. 1. Each shoe 33, 34 following the associated movement curve F1, F2 As periodically and alternately displaced forward and backward twice in the axial direction of the drive shaft 11 during one rotation of the wave cam 30. Centers Q1, Q2 of the spherical surfaces 33*a*, 34*a* coincide with the centers of the flat surfaces 33*b*, 34*b*, respectively. This allows the centers Q1, Q2 to constantly slide along the associated curves F1, F2. Accordingly, reciprocal movement of the pistons 16 within the associated cylinder bores 13*a*, 14*a* corresponds to the displacement of the pistons 16 along movement curves F1, F2 during rotation of the wave cam 30.

Figure 4:
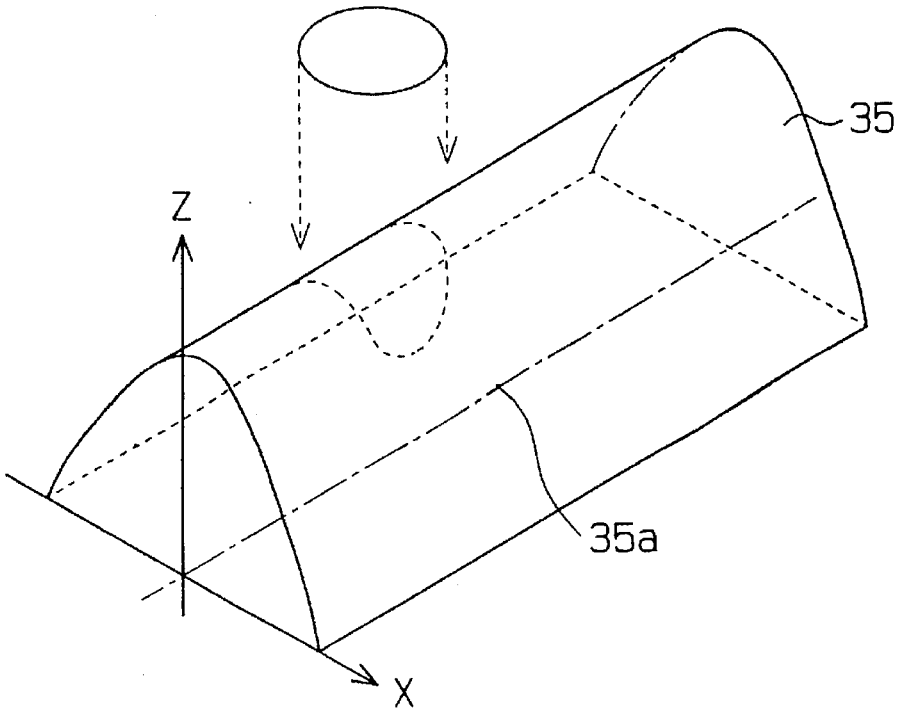
FIG. 4 is a perspective view of a conceptual parabolic surface.

As shown in FIG. 3, both cam surfaces 30*a*, 30*b* of the wave cam 30 are formed along a surface of a predetermined imaginary cylindroid (hereinafter referred to as cylindroid surface). The cam surfaces 30*a*, 30*b* each have a pair of first portions 30*c*, 30*e* and a pair of second portions 30*d*, 30*f*. The first portions 30*c*, 30*e* each move one head of a piston 16 to its top dead center position when aligned therewith while moving the opposing head to its bottom dead center position. The second portions 30*d*, 30*f* each move one head of a piston 16 to its bottom dead center position when aligned therewith while moving the opposing head to its top dead center position. Cross-sectional views of the wave cam 30 along lane segments perpendicular to a line connecting the two first portions 30*c* on the cam surface 30*a* each show identical contours. The above cylindroid surface is defined by moving a straight line along the contour, or director curve as indicated in FIG. 4.

Provided that a Z axis coincides with the axis L0, and that X axis is orthogonal to a Y axis coincided with a line connecting the two first portions 30*c*, which move the corresponding head of the pistons to the top dead center position, the above-described cylindroid surface is represented by the following equation (1):

$$Z=f(x) \quad (1)$$

The curved surface of each cam surface 30*a*, 30*b* is defined by a parabola, obtained from the next equation (2) in which X and Z are used as parameters, as the director curve. An imaginary parabolic semicylindroid is generated from the director curve. As shown in FIG. 4, the parabolic semicylindroid surface (hereinafter referred to as parabolic surface) 35 is cut from above along a circle to obtain the curved surfaces of each cam surface 30*a*, 30*b*. Two of such parabolic surfaces 35 are combined Back to back on the front and rear sides of the wave cam 30 to form the cam surfaces 30*a*, 30*b*. The parabolic surface 35 of the semicylindroid is generated by the director curve represented in the following equation (2):

$$Z=-C1\cdot X^2+C2 \quad (2)$$

C1 and C2 are constants which are determined by the dimensions of the compressor.

Employment of the parabolic surface 35 allows the two second portions 30*d* on the cam surface 30*a* to be separated from each other by an angular interval of 180 degree. In the some manner, the two second portions 30*f* and the two first portions 30*c* and 30*e* on the cam surfaces 30*a* and 30*b*, respectively, are separated from each other by angular intervals of 180 degrees. Furthermore, the first portions 30*c*, 30*e* are respectively separated from the second portions 30*d*, 30*f* by angular intervals of 90 degrees. Each second portion 30*d* of the surface 30*a* is formed back to back with each first portion 30*e* on the opposite surface 30*b*. Each first portion 30*c* of the surface 30*a* is formed back to back with each second portion 30*f* on the opposite surface 30*b*. Accordingly, the cam surfaces 30*a* and 30*b* are arranged in a manner such that there is a phase difference of 90 degrees therebetween. In addition, the cam surfaces 30*a*, 30*b*, employing the parabolic surface 35, are entirely convex.

For smooth reciprocation of the piston 16, the distance between each associated pair of shoes 33, 34 at the respective centers Q1, Q2 is required to be constant. That is, the distance between the movement curves F1, F2 must be constant along the direction of the axis L0. In order to satisfy this requirement, two conditions must be fulfilled.

The first condition is that the cam surfaces 30*a*, 30*b* of the wave cam 30 have the same contour. The second condition is that the first portions 30*c*, 30*e* of the respective cam surfaces 30*a*, 30*b*, which move the corresponding head of each piston 16 to the top dead center position, and the second portions 30*d*, 30*f* of the respective cam surfaces 30*a*, 30*b*, which move the corresponding head of each piston 16 to the bottom dead center position, have symmetrical contours.

The first condition is satisfied by employing the parabolic surface 35 cut along a circle as described above for each cam surface 30*a*, 30*b*. The second condition is satisfied by the cam surfaces 30*a*, 30*b* having a contour of a sine wave curve. In this embodiment, provided that the rotation angle of the wave cam 30 is indicated by θ and the stroke of the piston 16 is indicated by H, the relationship between the displacement of the centers Q1, Q2 of the respective shoes 33, 34 in the direction of Z axis and the rotation angle θ is indicated by the following equation (3):

$$Z(\theta)=(H/2)\cdot\cos(2\theta) \quad (3)$$

Since the cam surfaces 30*a*, 30*b* of the wave cam 30 have identical contours in this embodiment, a description of only the surface 30*a* will be given below. The rotation angle θ of the wave cam 30 is defined as zero degrees when the piston 16 is at the top dead center position in the cylinder bores 13*a*, 14*a*. The Z axis coincides with the axis L0 of the drive shaft 11. The Y axis is parallel to an axis 35*a* of the parabolic surface 35 which constitutes the cam surface 30*a*. The X axis is parallel to the axis 35*a* of the parabolic surface 35 which constitutes the cam surface 30*b*.

Figure 5:
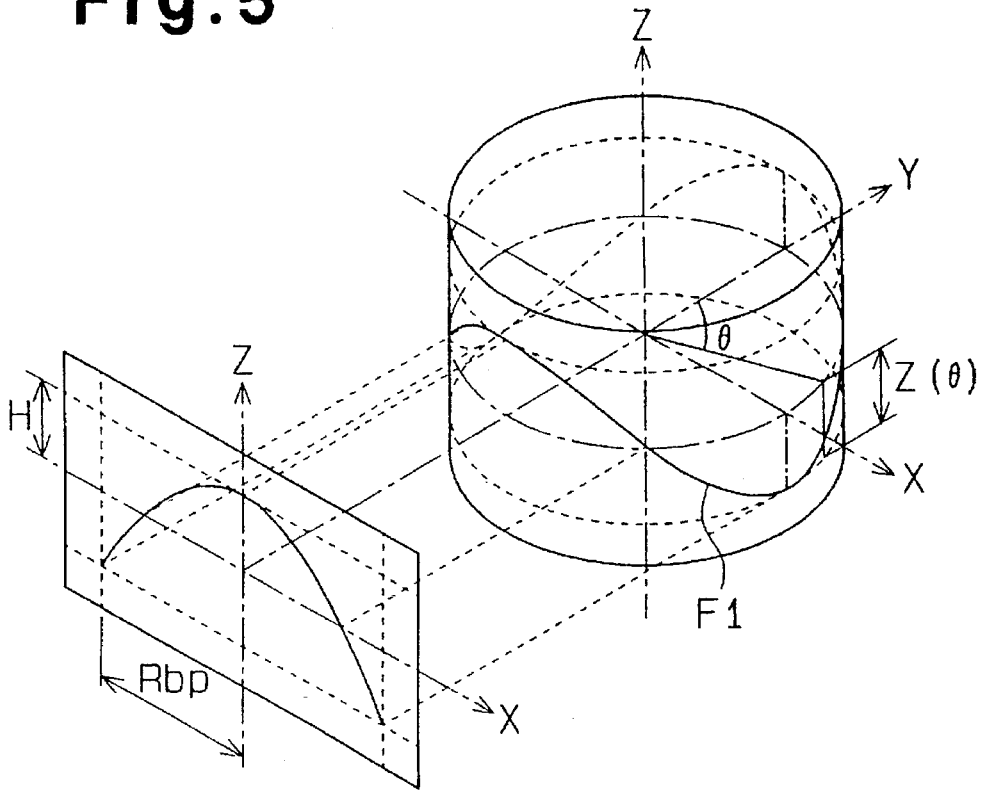
FIG. 5 is a diagram conceptually showing a movement curve of a wave cam surface.

As shown in FIG. 5, when the equation (3) is projected onto an X-Z plane, the X coordinate of Z(θ) is represented by the following equation (4):

$$X(\theta)=Rbp\cdot\sin\theta \quad (4)$$

Rbp indicates the radius of the circumference C0. From the equations (3) and (4), the relationship between the Z coordinate and the X coordinate is represented by the following equation (5):

$$\begin{aligned} Z(\theta) &= (H/2)\cdot\cos(2\theta) \\ &= (H/2)\cdot(1-2\cdot\sin^2\theta) \\ \therefore z(x) &= (H/2)\cdot(1-2X^2/Rbp^2) \\ &= H/2-H\cdot x^2/Rbp^2 \end{aligned} \quad (5)$$

The equation (5) represents a parabola and the following equation (6) is derived from the equations (2) and (5).

$$C1=H/Rbp^2$$

$$C2=H/2 \quad (6)$$

Namely, employment of the parabolic surface 35, which is generated from the director curve satisfying the equation (6), for the cam surfaces 30*a*, 30*b* of the wave cam 30 reciprocates the pistons 16 smoothly.

FIG. 2 is a cross-sectional view of FIG. 1 along line 2—2 showing one of the cam surfaces 30*a* of the wave cam 30. Since the cam surfaces 30*a*, 30*b* of the wave cam 30 have identical shapes, description of only the surface 30*a* will be given below. The rave cam 30 has a boss 26, grooves 37, and recesses 38. The boss 26 is fit onto the drive shaft 11. The grooves 37 and recesses 38 are defined between the boss 26 and the cam surface 30*a*. Each groove 37, which neighbors each associated first portion 30*c*, extends along the same circumference. The center of the circumference coincides with the center of the boss 26. Each recess 38, which neighbors each associated second portion 30*d*, extends more outward on the wave cam 30 than the grooves 37. The wave cam 30 has inclined surfaces 39, which are formed on the outer side of the cam surface 30*a* opposing the recess 38. Accordingly, a width V2 of the cam surface 30*a* in the vicinity of the second portion 30*d*, which is interposed between the recess 38 and the inclined surface 39, is more narrow than when compared with a width V1 of the cam surface 30*a* in the vicinity of the first portion 30*c*. The width V1 is more narrow than the flat surfaces 33*b*, 34*b* of the respective shoes 33, 34.

When the drive shaft 11 and the wave cam 30 are integrally rotated, the motion of the wave cam 30 reciprocates each piston 16 inside its associated cylinder bore 13*a*, 14*a* via the shoes 33, 34. As one of the heads of the piston 16 is moved from its top dead center position to its bottom dead center position in the associated cylinder bore 13*a*, 14*a*, refrigerant gas is introduced into the bores 13*a*, 14*a* from the suction chambers 24 through the suction ports 22. One of the heads of the piston 16 is then moved from its bottom dead center position to its top dead center position. This compresses the gas in the cylinder bores 13*a*, 14*a* and discharges the compressed gas into the discharge chambers 25 through the discharge ports 23.

During the reciprocation of the piston 16, the flat surfaces 33*b*, 34*b* of the shoes 33, 34 relatively rotate about the drive shaft 11 on the associated cam surfaces 30*a*, 30*b* of the wave cam 30 along the respective movement curves F1, F2. The movement curve F2 on the cam surface 30*b* is offset $\pi/2$ from the phase of the movement curve F1 on the cam surface 30*a*. The interval between the two curves F1, F2 in the direction of the Z axis, or the shaft 11 is constantly equal.

Figure 6:
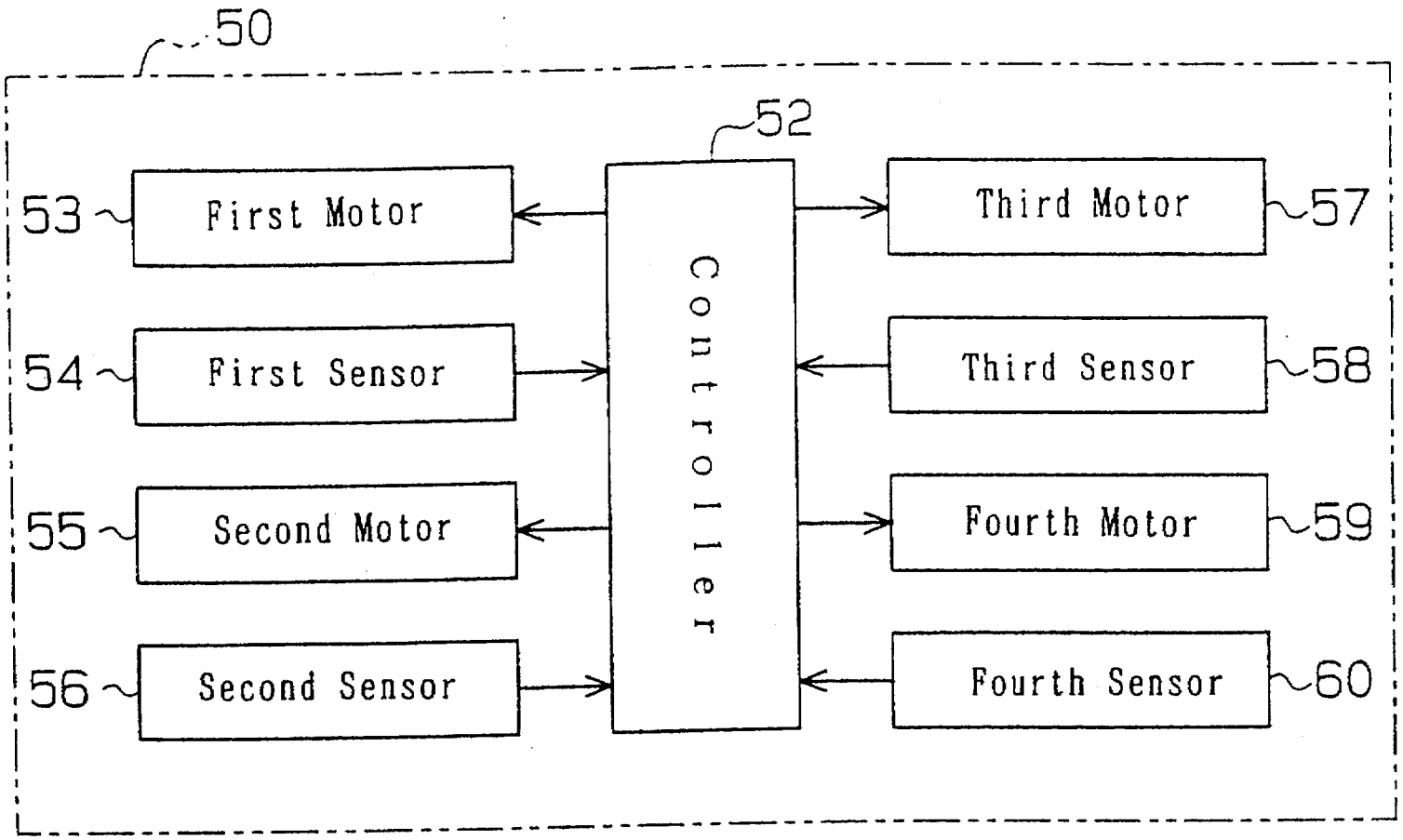
FIG. 6 is a schematic block diagram showing the controller for a milling machine used to grind the wave cam.
Figure 7A:
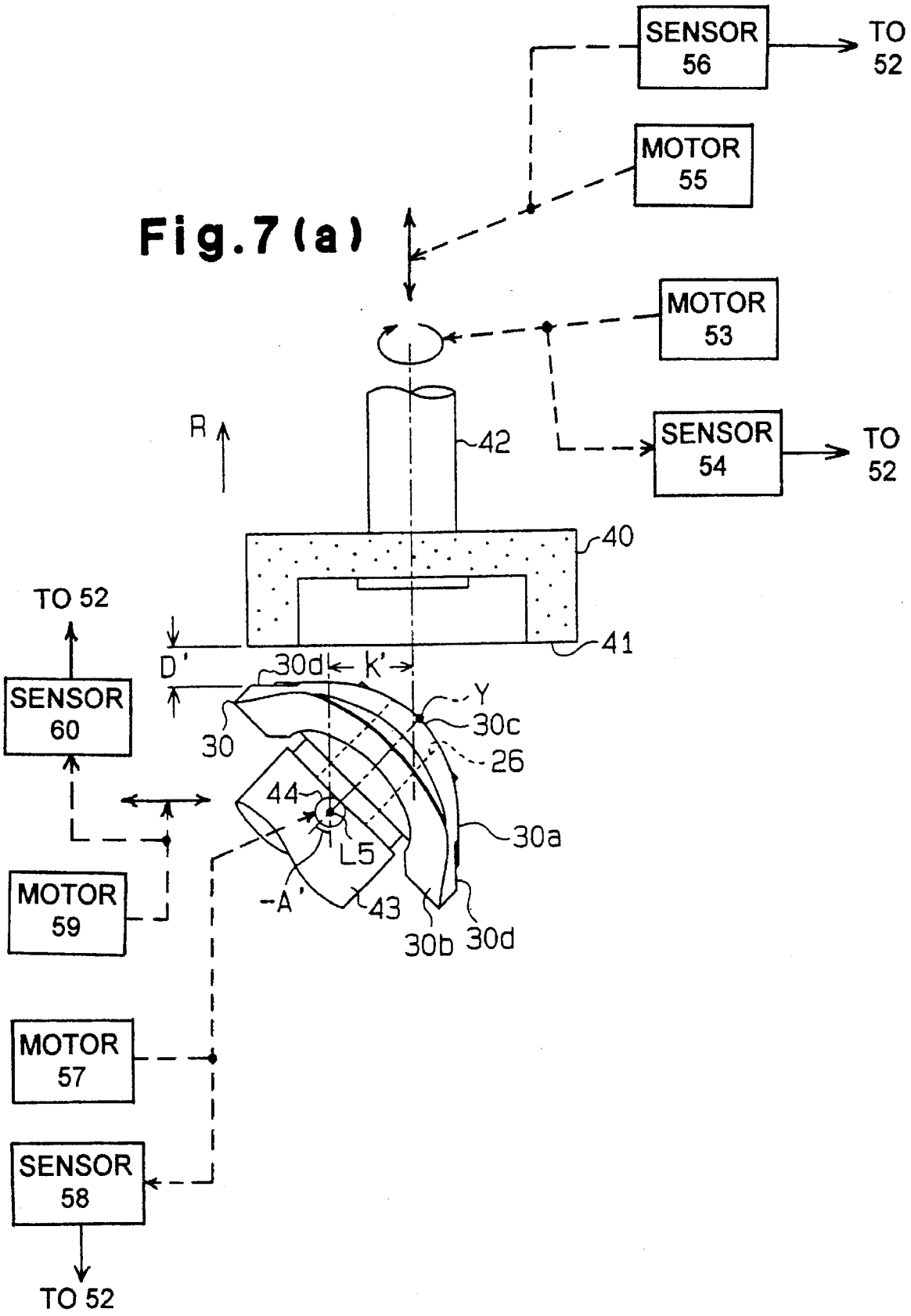
FIGS. 7(*a*) through 7(*d*) are schematic views sequentially showing a method for grinding the cam surface with a grinding stone.
Figure 7B:
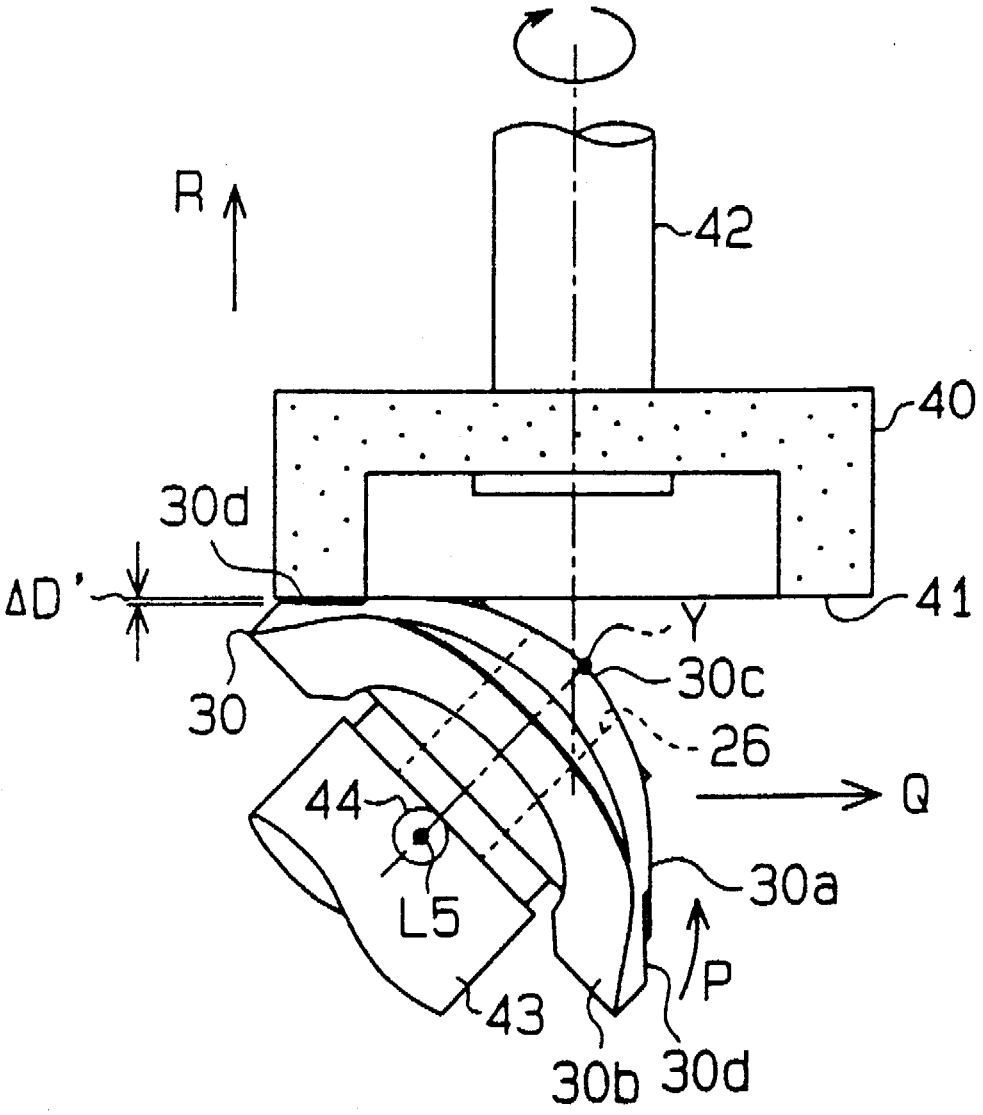
Figure 7D:
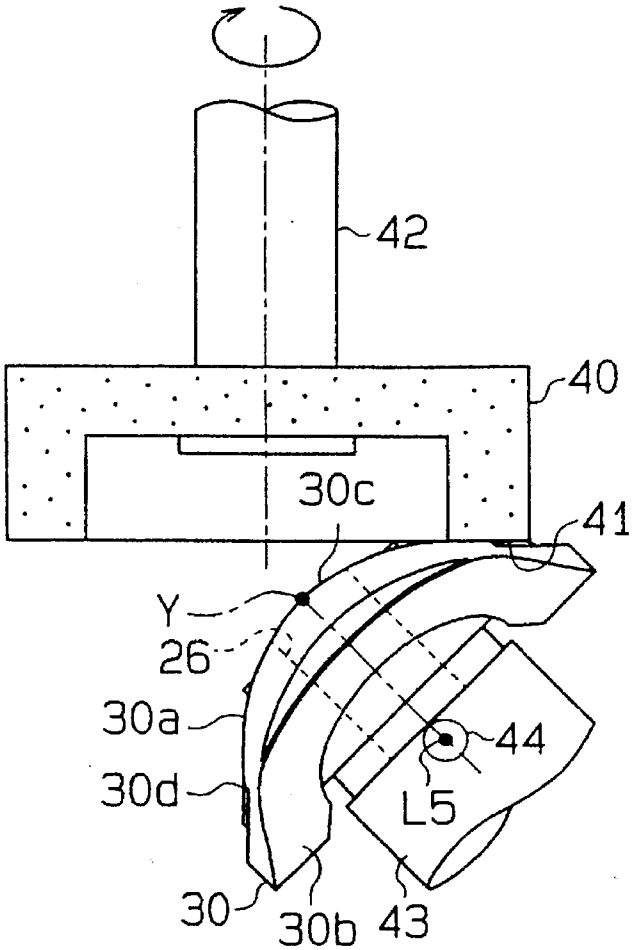
Figure 7C:
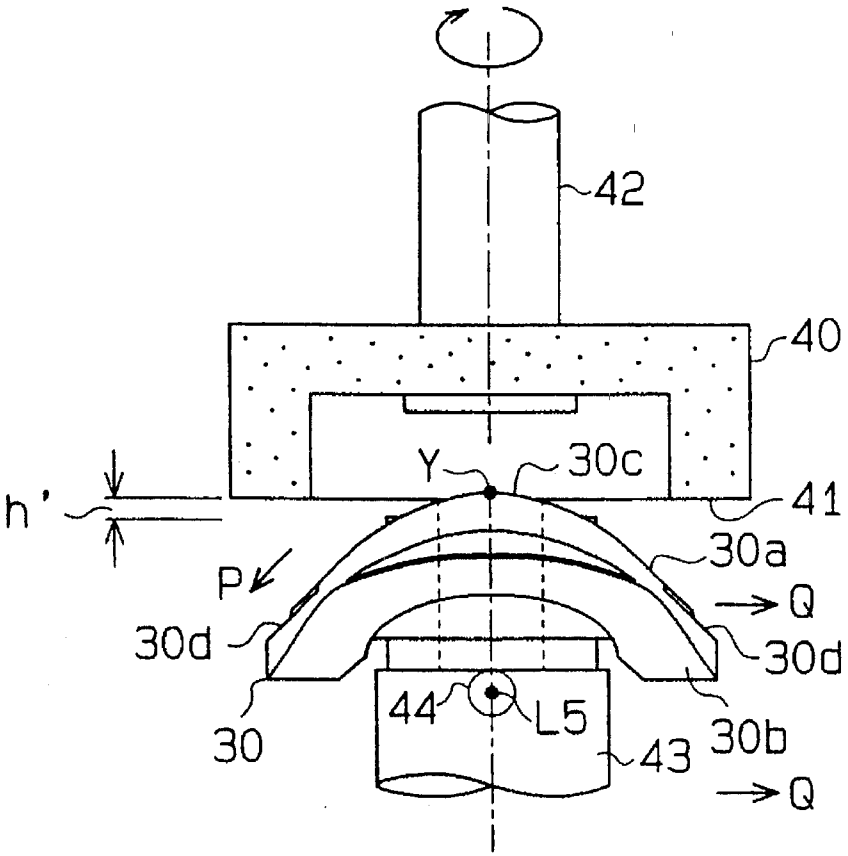

A milling machine 50 and its controller 52, used for grinding of the wave cam 30 in the present embodiment, will now be described with reference to FIGS. 6 and 7. The milling machine 50 includes a tiltable rotary table 43 which supports the wave cam 30, a rotary shaft 42 which supports a cup-shaped grinding stone 40, and the controller 52 which controls the drive of the rotary shaft 42 and rotary table 43. A counter, ROM, and RAM are incorporated in the controller 52. A program is input into the ROM prior to the grinding while the RAM continuously memorizes various calculations and processes executed by the controller 52.

The milling machine 50 includes a first motor 53 utilized to rotate the rotary shaft 42. The number of rotations of the motor 53 is detected by a first sensor 54. The milling machine 50 also has a second motor 55 which moves the rotary shaft 42, axially or vertically as viewed in FIG. 7(*a*). The number of rotations of the motor 55 is detected by a second sensor 56. Known rotation detecting means, such as pick-up coils or rotary encoders, may be used as the first and second sensors 54, 56. Each sensor 54, 56 sends the datum of the detected number of rotations of the motors 53, 55 to the controller 52.

The milling machine 50 further comprises a third motor 57 which pivots the tiltable rotary table 43. The number of rotations of the motor 57 is detected by a third sensor 58, which is a rotary encoder or the lake. The grinding machine 50 is also provided with a fourth motor 59 which moves the rotary table 43 laterally or horizontally as viewed in FIG. 7(*a*). The number of rotations of the motor 59 is detected by a fourth sensor 60, which its a pick-up coil, a rotary encoder, the like.

The manufacturing method of the wave cam 30 will now be described.

The original form of the wave cam 30 is obtained through molding such as die casting. The surface of the molded product is then deburred and holes are machined at predetermined positions. Finally, the surface of the molded product is ground to obtain the wave cam 30 with the cam surfaces 30*a*, 30*b*. The orbital path of the shoes 33, 34 on the respective cam surfaces 30*a*, 30*b* are then ground in the manner described below.

To grind the wave cam 30, as shown in FIG. 7(*a*), the rotary table 43 is tilted at an angle of −A' about its pivoting axis L5 to have one of the second portions 30*d* of the wave cam 30 facing the grinding stone 40. The grinding stone 40 is separated from the second portion 30*d* of the wave cam 30 by a distance D'. The second motor 55 is then rotated in the forward direction. This lowers the rotary shaft 42 and the grinding stone 40 over the distance D' to bring the surface 41 of the grinding stone 40 into contact with the second portion 30*d*, as shown in FIG. 7(*b*). The contact is accomplished when the number of rotations n2 of the motor 55 reaches D. It is required to firmly press the rotating grinding stone 40 against the second portion 30*d* for grinding. Hence, the grinding stone 40 is lowered a slight distance ΔD' to bring the grinding stone 40 into a state pressing the second portion 30*d* by further rotating the motor 55 in the forward direction. This is accomplished when the number of rotations n2 reaches AD. Accordingly, the second portion 30*d* and its vicinity on the cam surface 30*a* are ground by the rotating grinding stone 40.

The third motor 57 is then rotated in the forward direction. Simultaneously, the second motor 55 is rotated in the reverse direction while the fourth motor 59 is rotated in the forward direction. Thus, the rotary table 43 is pivoted about its pivoting axis L5 in a counterclockwise direction, as shown by an arrow P, while being moved laterally rightward as shown by the arrow Q. Simultaneously, the rotary shaft 42 and grinding stone 40 are moved upward as shown by an arrow R. More specifically, for grinding of the cam surface 30*a* over an area ranging from the second portion 30*d* to the first portion 30*c*, it is required for that an area contacting the grinding surface 41 of the grinding stone 40 on the cam surface 30*a* gradually change by integrally pivoting the wave cam 30 and the rotary table 43 in a counterclockwise direction. Simultaneously, the grinding stone 40 must be gradually raised for a distance equal to a height difference of h' between the first portion 30*c* and the second portion 30*d*, as shown in FIG. 7(*c*). As the number of rotations n3 of the third motor 57 reaches a predetermined value A, the rotary table 43 becomes pivoted by an angle of A' thus allowing the first portion 30*c* of the wave cam 30 to face the grinding stone 40 as shown in FIG. 7(*c*). At this state, the rotary table 43 is moved horizontally by a distance of k' when the number of rotations n4 of the fourth motor 59 reaches a predetermined value k. Furthermore, the grinding stone 40 become raised by a distance equal to the height difference h' as the number of rotations n2 of the second motor 55 reaches a value h. Accordingly, the left half of the orbital path on the cam surface 30*a* becomes ground as shown in FIG. 7(*c*).

The third and fourth motors 57, 59 further continue rotation in the forward direction. The second motor 55 changes its rotation to the forward direction. This further pivots the wave cam 30 integrally with the rotary table 43 in the counterclockwise direction to grind the right half of the wave cam 30 over an area ranging from the first portion 30*c* to the second portion 30*d*. The area contacting the grinding surface 41 of the grinding stone 40 on the cam surface 30*a* gradually moves toward the other second portion 30*d*. That is, the rotary table 43 is moved rightward, as viewed in FIG. 7(*b*), and thus the other portion 30*d*, which is separated by 180 degrees from the portion 30*d* being ground in FIG. 7(*b*), comes into contact with the grinding stone 40 as shown in FIG. 7(*d*). Furthermore, the second motor 55 rotating forward lowers the grinding stone 40 integrally with the rotary shaft 42 for a distance equal to the height difference h' and comes into the state shown in FIG. 7(*d*). Accordingly, the right half of the cam surface 30*a* is ground. The opposite surface 30*b* is ground in an identical manner.

Figure 8:
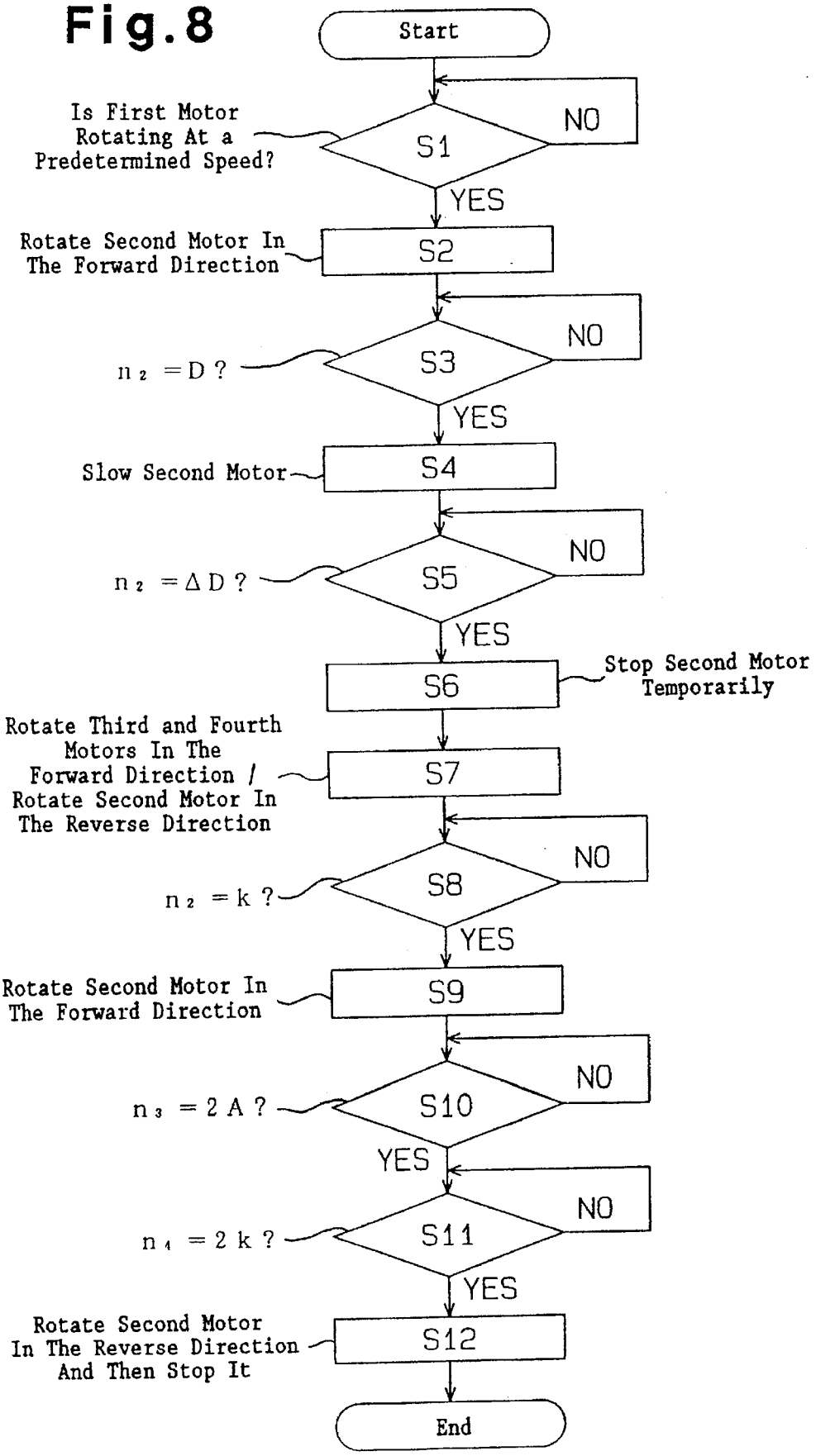
FIG. 8 is a flow chart showing operation of a controller.
Figure 9:
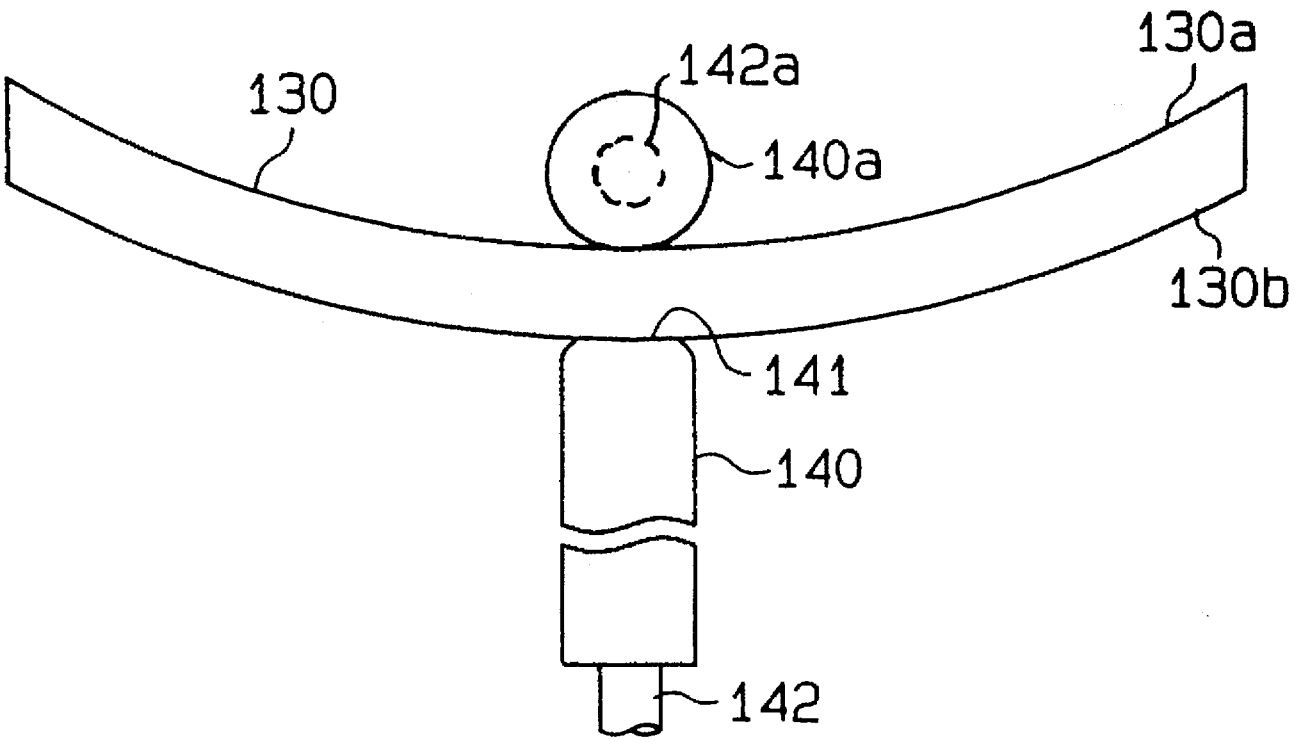
Figure 10:
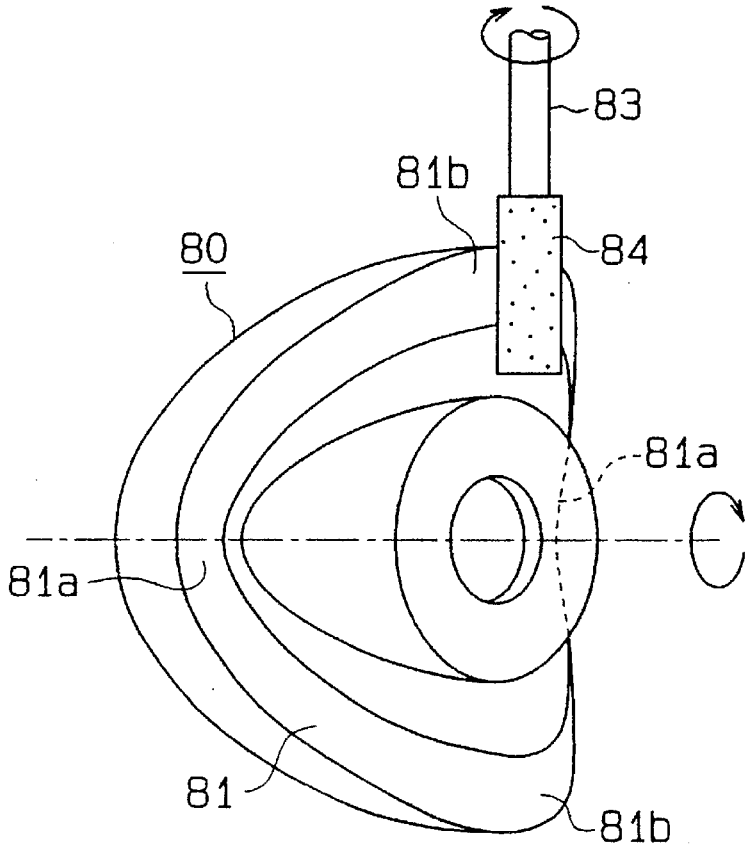
Fig.10 (Prior Art)
FIG. 10 is a perspective view of a prior art wave cam, having a cam surface with concave and convex surfaces, undergoing grinding.
Figure 11:
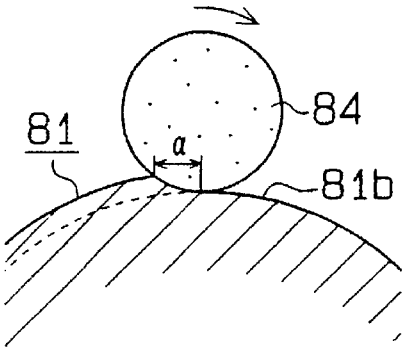
Fig.11 (Prior Art)
FIG. 11 is a partial cross-sectional view of the convex surface of the wave cam shown in FIG. 10 undergoing grinding.
Figure 12:
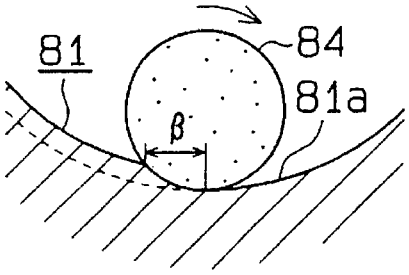
Fig.12 (Prior Art)
FIG. 12 is a partial cross-sectional view of the concave surface of the wave cam in FIG. 10 undergoing grinding.
Figure 13:
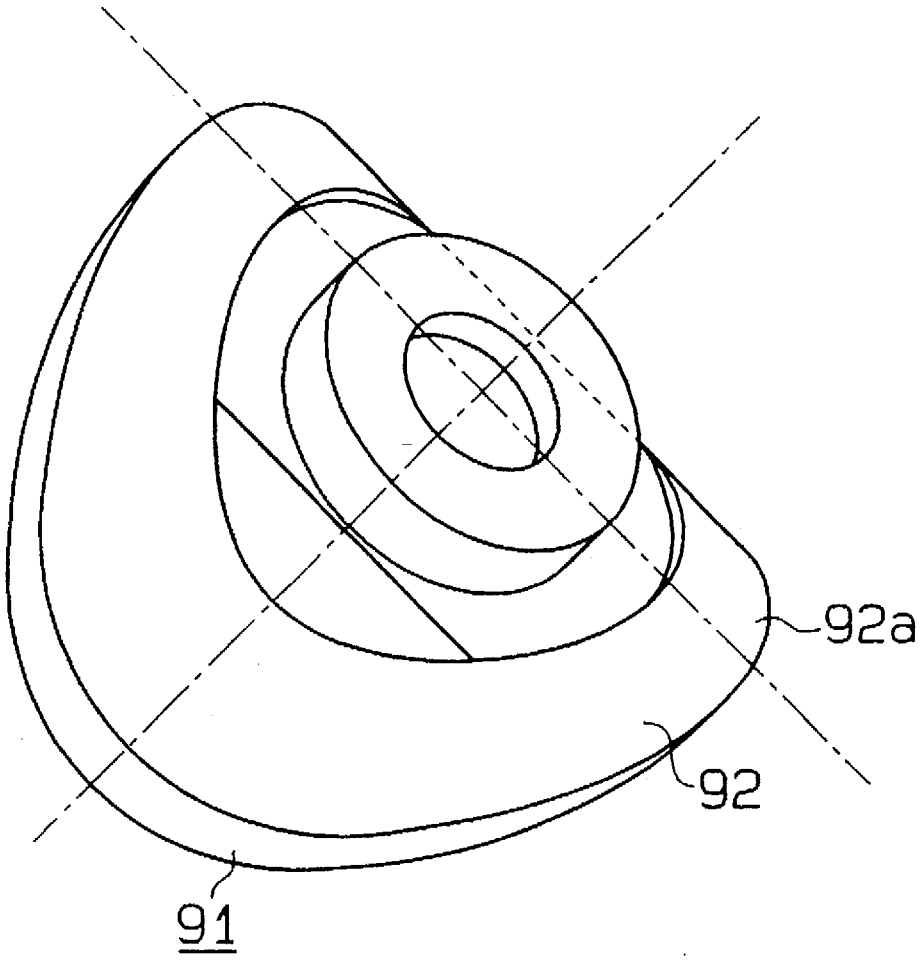
Fig.13 (Prior Art)
FIG. 13 is a perspective view of a prior art wave cam having a cam surface which comprises only convex surfaces.

Operation of the controller 52 will be described with reference to the flow chart shorn in FIG. 8.

In FIG. 7(*a*), the wave cam 30 is tilted at the angle −A' below the grinding stone 40. The grinding stone 40 is positioned having the distance D' from the wave cam 30. In this state, the second portion 30*d* is opposed with the surface 41 of the grinding stone 40. When the controller 52 confirms that the first motor 53, i.e., the grinding stone 40, is being rotated at a predetermined speed from signals sent by the first sensor 54 in step S1, the second motor 55 is rotated in the forward direction to lower the grinding stone 40 in step S2. When the controller 52 confirms that the number of rotations n2 of the motor 55 has reached a predetermined value D from signals sent by the second sensor 56 in step S3, the controller 52 determines that the grinding surface 41 of the grinding stone 40 has contacted one of the second portions 30*d* of the cam surface 30*a*. Then in step S4, the rotating speed of the second motor 55 is slowed down. When the number of rotations n2 of the second motor 55 reaches ΔD in step S5, the motor 55 is temporarily stopped in step S6.

In step S7, the controller 52 rotates the third and fourth motors 57, 59 in the forward direction, and gradually raises the grinding stone 40 by rotating the second motor 55 in the reverse direction. In step S8, when the controller 52 confirms that the number of rotations n2 of the motor 55 has reached the predetermined value h from a signal sent by the second sensor 56, it determines that the first portion 30*c* has come into contact with the grinding surface 41. In step S9, the controller 52 temporarily stops the motor 35 and then starts rotation of the motor 55 in the forward direction to lower the grinding stone 40 once more. In step S10, the controller 52 confirms that the number of rotations n3 of the third motor 57 has reached a predetermined value 2A from a signal sent by the third sensor 38. In step S11, the controller 52 confirms that the number of rotations n4 of the fourth motor 59 has reached a value two times the predetermined value k from a signal sent by the fourth sensor 60 and determines that the orbital path of the shoes 33, 34 on the cam surface 30*a* has entirely been ground. In step 12, the controller 52 temporarily stops the second motor 55 and then rotates the second motor 55 in the reverse direction and moves the grinding stone 40 away from the wave cam 30 in an upward direction. The motor 55 is then stopped to complete the grinding.

In this embodiment, the wave cam 30 is provided with the grooves 37 and the recesses 38. Each groove 37 As defined at the inner aide of the cam surfaces 30*a*, 30*b* and neighbors respective first portions 30*c*, 30*e*, each moves the corresponding head of the piston 16 to the top dead center position. The recess 38 is extended outwardly. In addition, the wave cam 30 includes the inclined surface 39 which is formed on the outer side of the cam surfaces 30*a*, 30*b*. Namely, the width V2 of the cam surfaces 30*a*, 30*b* at the respective second portions 30*d*, 30*f* is more narrow than when compared with the width V1 of the cam surfaces 30*a*, 30*b* at the first portions 30*c*, 30*e*.

Accordingly, the hollowed portion of the wave cam 30, where the width V2 is narrow allows a reduction in weight of the wave cam 30. Additionally, the width V2 of the cam surfaces 30*a*, 30*b* at the respective second portions 30*d*, 30*f*, which move the corresponding head of each piston 16 to the bottom dead center position, is more narrow than when compared with the width V1 of the cam surfaces 30*a*, 30*b* at the respective first portions 30*c*, 30*e*. Therefore, the contact area between the cam surfaces 30*a*, 30*b* and the grinding stone 40 is reduced. This allows minimizing of the area to be ground by the grinding stone 40 and contributes to prolonging its tool life.

In this embodiment, although the width V2 of the cam surfaces 30*a*, 30*b* at the vicinity of the second portions 30*d*, 30*f* is narrow, the pressing force which acts on these portions 30*d*, 30*f* is small. Refrigerant gas introduced into the cylinder bores 13*a*, 14*a* is compressed when each head of the piston 16 is moved from the bottom dead center position to the top dead center position. During this compression stroke, the compression reaction force applied to the cam surfaces 30*a*, 30*b* via the associated shoes 33, 34 is maximized since the pressure inside the cylinder bores 13*a*, 14*a* is maximized. Therefore, it is desirable for the width v1 of the cam surfaces 30*a*, 30*b* at the respective first portions 30*c*, 30*e* to be substantially equal to the width of the flat surfaces 33*b*, 34*b* of the respective shoes 33, 34.

Contrarily, when refrigerant gas is being introduced into the cylinder boxes 13*a*, 14*a*, the pressure inside the cylinder bores 13*a*, 14*a* becomes negative. As a result, the reaction force applied to the cam surfaces 30*a*, 30*b* via the respective shoes 33, 34 is so small that it may be disregarded.

In this embodiment, the grinding face 41, which is on the end portion of the grinding stone 40, is pressed against the cam surfaces 30*a*, 30*b* perpendicular thereto during grinding. Therefore, the moment acting on the rotary shaft 42 is minimized and deflection of the rotary shaft 42 is prevented. This enables high precision grinding of the cam surfaces 30*a*, 30*b*. As a result, production of the wave cam 30 with high dimensional accuracy is possible. By using such wave cam 30, it is possible to manufacture a wave cam type compressor having high compressing efficiency.

Furthermore, in this embodiment, the grinding stone 40 used to grind the wave cam 30 has an outer diameter larger than the outer diameter of the cam wave 30. Therefore, it is possible to simultaneously grind two portions that are symmetrical about the X axis as shown in the cross-hatched area of FIG. 9(*a*). This allows the wave cam 30 to he formed having the same surface roughness and the same dimension at portions which are symmetrical to each other about the X axis. In addition, it is possible to greatly reduce the grinding time of the wave cam 30.

Although only one embodiment of the present invention has been described herein, it should be apparent to those skilled in the art that the present invention may be embodied in many other specific forms without departing from the spirit or scope of the invention. Particularly, it should be understood that the present invention may be embodied in the forms described below.

Figure 9:
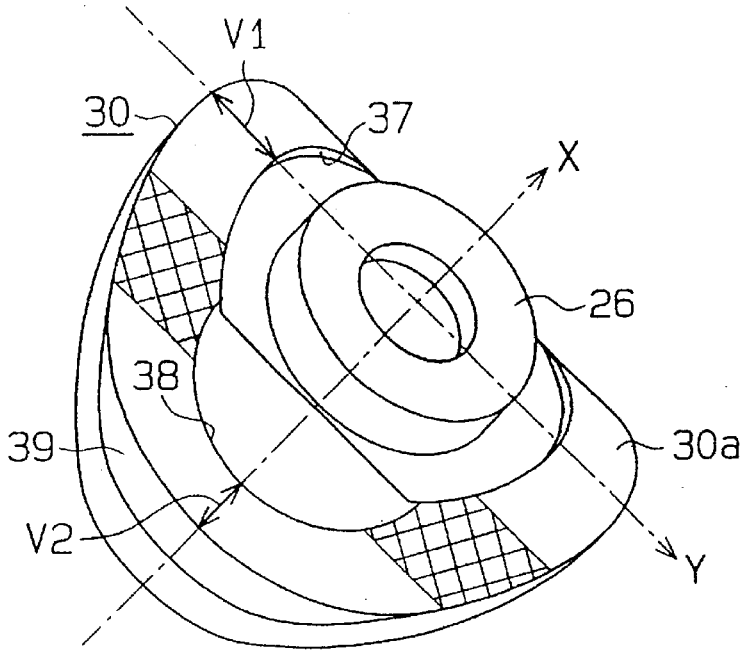
FIG. 9(*a*) is a perspective view showing the wave cam in a ground state.

As shown in FIG. 9(*b*), cam surfaces 130*a*, 130*b* of a wave cam 130 may be defined having a concave surface and a convex surface. For grinding of the convex cam surface 130*b*, the cam surface 130*b* is positioned perpendicular to an axis 142 of a grinding stone 140, which has a grinding surface 141 on its end face. As for the concave cam surface 130*a*, the cam surface 130*a* is ground by a grinding stone 140*a* on a shaft 142*a* which axis extends horizontally with respect to the cam surface 130*a*.

In the first embodiment described with reference to FIGS. 1–5, the cam surfaces 30*a*, 30*b* are formed from portions of the imaginary parabolic surface 35. Contrarily, a wave cam including both concave and convex surfaces may be employed.

The grinding stone 40 has an outer diameter which is larger than the outer diameter of the wave cam 30 in the above embodiment. However, significance is placed on the width of the grinding stone being wider that the cam surface, and the axis of the grinding stone being positioned perpendicular to the cam surface during grinding. This prevents deflection of the rotary shaft of the grinding stone and achieves high precision grinding of the cam surface, which is an object of the present invention.

The director curve uses a predetermined parabola to obtain the imaginary parabolic surface 35 which forms the cam surfaces 30*a*, 30*b* in the above embodiment. However, the director curve may use any kind of curve which is symmetrical as in the above embodiment.

Therefore, the present example and embodiments are to be considered as illustrative and not restrictive and the invention is not to be limited to the details given herein, but may be modified within the scope of the appended claims.

What is claimed is:

1. A method for manufacturing a wave cam used in a compressor, said wave cam including a cam surface which has a predetermined orbital path for a cam follower which is relatively movable with respect to said cam surface, wherein said orbital path is ground by a grinding stone mounted on a rotary shaft, said method comprising the steps of:

forming the cam surface as a part of a surface of an imaginary parabolic cylindroid, said imaginary parabolic cylindroid being determined by the locus of a predetermined parabolic curve;

arranging said rotary shaft perpendicular to said cam surface; and moving an end surface of said grinding stone along said orbital path of said cam surface.

2. The method as set forth in claim 1, said grinding stone being attached to a milling machine, wherein said milling machine includes;

a table disposed facing the rotary shaft to support said wave cam;

a controller for actuating said table to change a relative position of said grinding stone and said wave cam.

3. The method as set forth in claim 2, wherein said milling machine includes.

first actuating means for rotating said rotary shaft about an axis thereof;

second actuating medals for selectively moving the rotary shaft toward and away from said table;

third actuating means for moving the table by a predetermined distance; and a plurality of detecting means, each of said detecting means being arranged in association with each of said actuating means to detect an operation of each actuating means.

4. A method for manufacturing a wave cam used in a compressor, said wave cam including a cam surface which has a predetermined orbital path for a shoe coupling said cam surface to a piston, said shoe being arranged to move relative to the orbital path of said cam surface to convert a rotation of the drive shaft into a reciprocal movement of the piston between a top dead center and a bottom dead center in a cylinder bore so as to compress gas in aid cylinder bore and discharge the compressed gas from said cylinder bore, wherein said orbital path is ground by a grinding stone mounted on a rotary shaft; said method comprising steps of:

forming the cam surface as a part of a surface of an imaginary parabolic cylindroid, said imaginary parabolic cylindroid being determined by the locus of a predetermined parabolic curve;

arranging said rotary shaft perpendicular to said cam surface; and moving an end surface of said grinding stone along said orbital path of said cam surface.

5. The method as set forth in claim 4, wherein said wave cam has a convex profile on a single side surface.

6. The method as set forth in claim 4, wherein said cam surface includes a partial surface of an imaginary cylindroid.

7. The method as set forth in claim 6, wherein said cam surface includes:

a pair of first portions corresponding to the top dead center;

a pair of second portions corresponding to the bottom dead center, said second portions continuously expanding to the first portions; and each pair of said first portions and second portions being out of phase from one another by 180.

8. The method as set forth in claim 7, wherein said orbital path is circular in a plan view, and wherein said grinding store is cylindrical and has a flat end surface, said end surface having a diameter larger than said orbital path end being adapted to cover said orbital path when in use.

9. The method as set forth in claim 7, said grinding stone being attached to a milling machine, wherein said milling machine includes:

a table disposed facing the rotary shaft to support said wave cam;

a controller for actuating said table to change a relative position of said grinding stone and said wave cam.

10. The method as set forth in claim 9, wherein said milling machine includes:

first actuating means for rotating said rotary shafts bout an axis thereof;

second actuating means for selectively rotating the rotary shaft toward and away from said table;

third actuating means for moving the table by a predetermined distance; and a plurality of detecting means, each of said detecting means being arranged in association with each of said actuating means to detect an operation of each actuating means.

11. The method as set forth in claim 10 further comprising the steps of:

disposing one of said second portions facing said end surface of the grinding stone by rotating the table supporting said wave cam; and moving the rotary shaft toward the table to bring the end surface of the grinding stone into contact with said second portion.

12. The method as set forth in claim 11, wherein said step of moving said grinding stone into contact with said second portion includes the steps of:

bringing said end surface of the grinding stone into contact with the second portion; and moving said rotary shaft toward the second portion to urge said end surface of the grinding stone against the second portion.

13. The method as set forth in claim 7, wherein said end surface of the grinding stone grinds a pair of said first portions simultaneously.

14. The method as set forth in claim 7, wherein said end surface of the grinding stone has different portions for respectively grinding different portions of the orbital path including said first portions and said second portions.

15. A method for manufacturing a wave cam used in a compressor, said wave cam being supported on a drive shaft for integral rotation and including a pair of opposed cam surfaces which respectively have predetermined orbital paths for shoes coupling said cam surfaces to a double-headed piston, each of said shoes being arranged to move relative to the orbital path on the associated cam surface to convert a rotation of the drive shaft into a reciprocal movement of the piston between a top dead center and a bottom dead center in a cylinder bore so as to compress gas in said cylinder bore and discharge the compressed gas from said cylinder bore, wherein each of said cam surfaces includes a partial surface of an imaginary cylindroid, wherein each of said orbital paths includes a pair of first portions corresponding to the top dead center and a pair of second portions corresponding to the bottom dead center and wherein said wave cam is ground by a grinding stone mounted on a rotary shaft; said method comprising the steps of:

forming the cam surface as a part of a surface of an imaginary parabolic cylindroid, said imaginary parabolic cylindroid being determined by the locus of a predetermined parabolic curve;

arranging said rotary shaft perpendicular to said cam surface; and rotating the grinding stone relative to the cam surface while imparting relative movement of an end surface of said grinding stone along said orbital path of said cam surface.

16. The method as set forth in claim 15, wherein said orbital path is circular in a plan view, and wherein said grinding stone is cylindrical and has a flat end surface, said end surface having a diameter larger then said orbital path and being adapted to cover said orbital path when in use.

17. The method as set forth in claim 16, wherein said wave cam includes a pair of opposed convex profiles.

18. The method as set forth in claim 15, wherein each pair of said first portions and second portions are out of phase from one another by 180°.

19. The method as set forth in claim 18, said grinding stone being attached to a milling machine, wherein said milling machine includes:

a table disposes facing the rotary shaft to support said wave cam;

a controller for actuating said table to change a relative position of said grinding stone and said wave cam.

20. The method as set forth in claim 19, wherein said milling machine includes:

first actuating means for rotating said rotary shaft about an axis thereof;

second actuating means for selectively moving the rotary shaft toward and away from said table;

third actuating means for pivoting the table by a predetermined distance; and a plurality of detecting means, each of said detecting means being arranged in association with each of said actuating means to detect an operation of each actuating means.

21. The method as set forth in claim 20 further comprising the steps of:

disposing one of said second portions facing said end surface of the grinding stone by rotating the table supporting said wave cam; and moving the rotary shaft toward the table to bring the end surface of the grinding stone into contact with said second portion.

22. The method as set froth in claim 21, wherein said grinding stone moves relatively to the cam surface in such a manner that the rotary shaft follows a line passing said second portions.

23. The method as set forth in claim 21, wherein said step of said moving said grinding stone into contact with said second portion includes the steps of:

bringing said end surface of the grinding stone into contact with the second portion to position the end surface; and moving said rotary shaft toward the second portion to urge said end surface of the grinding stone against the second portion.

24. The method as set forth in claim 20, wherein said end surface of the grinding stone grinds a pair of said first portions simultaneously.

25. The method as set forth in claim 20, wherein said end surface of the grinding stone has different portions for respectively grinding different portions of the orbital path including said first portions and said second portions.

26. A method of manufacturing a wave cam for use in a compressor where said wave cam has a cam surface that provides an orbital path for traversal by a cam follower as the wave cam is rotated, said cam surface being open cylindrical and defined by a non-finite directrix in the form of a parabolic curve such that said orbital path is continuously convex free from points of inflection, said parabolic curve having a vertex point and terminating at first and second end points equidistant from said vertex point on opposite sides of the principal axis of the parabolic curve, said method comprising the steps of:

providing a work piece having an open parabolic cylindrical cam surface of rough dimension requiring precision grinding to produce said orbital path, supporting said work piece for rotation about a pivot axis and for linear lateral translation in a first direction perpendicular to said pivot axis where said pivot axis is parallel to the elements of said cylindrical cam surface and passing perpendicularly through the principal axis of the parabolic curve, supporting a grinding stone, having a grinding surface lying in a plane, for rotation about a central axis normal to said plane and movable axially toward and away from said pivot axis, and coordinating the movement of said grinding stone toward and away from said work piece with linear translation of said work piece in said first direction and rotation of said work piece about said pivot axis while said grinding stone is rotating to grind said orbital path.

27. The method as set forth in claim 26, wherein the plan view of said orbital path as viewed along said principal axis is substantially circular with a predetermined outer diameter, comprising the further step of employing a grinding stone of generally circular configuration having an outer diameter at least as large as said predetermined outer diameter.

28. The method as set forth in claim 27, comprising the step of employing a cup shape grinding stone with said grinding surface on the lip of the cup.

29. The method as set forth in claim 28, where said orbital path is in the form of a closed loop of finite width, said finite width varying between a maximum and a minimum with the maximum width occurring at two locations spaced 180° apart and straddling said vertex point and the minimum width occurring at two locations spaced 90° from each of said maximum width locations and adjacent said respective end points of said parabolic curve, comprising employing a cup shape grinding stone where the walls of the cup have a thickness at least as great as said maximum width.

30. The method as set forth in claim 29, comprising rotating said work piece about said pivot axis until the tangent plane to said cylindrical surface adjacent a location corresponding to one of said end points of said parabolic curve is substantially parallel to said plane of said grinding stone, moving said central axis of said grinding stone a predetermined distance axially toward said pivot axis until said grinding stone engages said work piece at said one end point location and then advancing said grinding stone an additional incremental distance to apply pressure to said work piece and grind said minimum width location of said orbital path, thereafter rotating said work piece about said pivot axis until the element of said cylindrical surface corresponding to said vertex point engages said grinding stone while said pivot axis is being translated laterally and said central axis of said grinding stone is being moved axially away from said pivot axis, then continuing to rotate said work piece about said pivot axis while continuing to translate said pivot axis laterally and reversing the direction of axial movement of said grinding stone until contact is established with the cam surface corresponding to the opposite end point, all coordinated to grind an accurate parabolic cylindrical surface.

31. The method as set forth in claim 26, comprising rotating said work piece about said pivot axis until the tangent plane to said cylindrical surface adjacent a location corresponding to one of said end points of said parabolic curve is substantially parallel to said plane of said grinding stone, moving said central axis of said grinding stone a predetermined distance axially toward said pivot axis until said grinding stone engages said work piece at said one end point location and then advancing said grinding stone an additional incremental distance to apply pressure to said work piece and grind said location of said orbital path, thereafter rotating said work piece about said pivot axis until the element of said cylindrical surface corresponding to said vertex point engages said grinding stone while said pivot axis is being translated laterally and said central axis of said grinding stone is being moved axially away from said pivot axis, then continuing to rotate said work piece about said pivot axis while continuing to translate said pivot axis laterally and reversing the direction of axial movement of said grinding stone until contact is established with the cam surface corresponding to the opposite end point, all coordinated to grind an accurate parabolic cylindrical surface.

32. The method as set forth in claim 31, wherein the plan view of said orbital path as viewed along said principal axis is substantially circular with a predetermined outer diameter, comprising the further step of employing a grinding stone of generally circular configuration having an outer diameter at least as large as said predetermined outer diameter.

33. The method as set forth in claim 32, comprising the step of employing a cup shape grinding stone with said grinding surface on the lip of the cup.

* * * * *

UNITED STATES PATENT AND TRADEMARK OFFICE

CERTIFICATE OF CORRECTION

PATENT NO. : 5,655,953
DATED : August 12, 1997
INVENTOR(S) : K. Murakami et al.

It is certified that error appears in the above-indentified patent and that said Letters Patent is hereby corrected as shown below:

Column 1, line 25, change first word "Within" to --within--;
line 43, change ";" to --.--.
line 53, delete "type" (second occurrence);
line 55, insert --compressor.-- after last word "type".

Column 2, line 21, change "a" (last word) to --the--;
line 29, change first word "end" to --and--;
line 37, change "ell" to --all--.

Column 4, line 1, insert --is-- before first word "accommodated";
line 34, change "As" to --is--.
line 57, change first word "lane" to --line--;
line 63, insert --an-- before "X".

UNITED STATES PATENT AND TRADEMARK OFFICE

CERTIFICATE OF CORRECTION

PATENT NO. : 5,655,953
DATED : August 12, 1997
INVENTOR(S) : K. Murakami et al.

It is certified that error appears in the above-indentified patent and that said Letters Patent is hereby corrected as shown below:

Column 5, line 11, change "Back" to --back--;
line 23, change first word "some" to --same--.

Column 7, line 32, change "lake" to --like--;
line 37, insert --or-- before first word "the";
line 65, change "AD" to --ΔD--.

Column 8, line 25, change first word "become" to --becomes--.

Column 9, line 14, change "sensor 38" to --sensor 58--;
line 28, insert --the-- before first word "respective".

UNITED STATES PATENT AND TRADEMARK OFFICE

CERTIFICATE OF CORRECTION

PATENT NO. : 5,655,953
DATED : August 12, 1997
INVENTOR(S) : K. Murakami et al

It is certified that error appears in the above-indentified patent and that said Letters Patent is hereby corrected as shown below:

Column 10, line 16, change "he" to --be--.

Column 11, line 62, change first word "store" to --stone--.

Column 12, line 7, change "bout" to --about--.

Column 13, line 41, change "relatively" to --relative--.

Signed and Sealed this
Fifth Day of January, 1999

*Attest:*

*Attesting Officer*

*Acting Commissioner of Patents and Trademarks*